US009394582B2

(12) United States Patent
Klarner

(10) Patent No.: US 9,394,582 B2
(45) Date of Patent: Jul. 19, 2016

(54) METHOD AND APPARATUS FOR PRODUCING STEEL PIPES HAVING PARTICULAR PROPERTIES

(75) Inventor: Juergen Klarner, Mitterdorf (AT)

(73) Assignee: VOESTALPINE TUBULARS GMBH & CO KG, Kindberg-Aumuehl (AT)

( * ) Notice: Subject to any disclaimer, the term of this patent is extended or adjusted under 35 U.S.C. 154(b) by 262 days.

(21) Appl. No.: 13/128,838

(22) PCT Filed: Nov. 16, 2009

(86) PCT No.: PCT/AT2009/000439

§ 371 (c)(1),
(2), (4) Date: Jul. 8, 2011

(87) PCT Pub. No.: WO2010/057235

PCT Pub. Date: May 27, 2010

(65) Prior Publication Data

US 2011/0272067 A1 Nov. 10, 2011

(30) Foreign Application Priority Data

Nov. 20, 2008 (AT) ..... A 1814/2008

(51) Int. Cl.

| | |
|---|---|
| ***C21D 9/08*** | (2006.01) |
| ***C21D 8/10*** | (2006.01) |
| ***C22C 38/04*** | (2006.01) |
| *C21D 1/62* | (2006.01) |

(52) U.S. Cl.

CPC ..... *C21D 9/085* (2013.01); *C21D 8/105* (2013.01); *C22C 38/04* (2013.01)

(58) Field of Classification Search

CPC ..... C21D 8/105; C21D 9/085

USPC ..... 148/593

See application file for complete search history.

(56) References Cited

U.S. PATENT DOCUMENTS

| | | | | |
|---|---|---|---|---|
| 3,507,712 | A | 4/1970 | Scott | |
| 5,653,937 | A | 8/1997 | Kim et al. | |
| 5,771,443 | A * | 6/1998 | Nagano et al. | 455/115.4 |

(Continued)

FOREIGN PATENT DOCUMENTS

| | | |
|---|---|---|
| EP | 1 516 934 A1 | 3/2005 |
| JP | 54-37011 A | 3/1979 |

(Continued)

OTHER PUBLICATIONS

Translation of the International Preliminary Report of Patentability and Written Opinion of the International Searching Authority.

*Primary Examiner* — Rebecca Lee

(74) *Attorney, Agent, or Firm* — Kilpatrick Townsend & Stockton LLP

(57) ABSTRACT

The invention relates to a method and to an apparatus for producing pipes made of steel. According to the invention, within a period of time of no more than 20 seconds after the last deformation at a temperature greater than 700° C., but less than 1050° C., during passage a cooling medium is applied with elevated pressure onto the outside circumference of the pipe over a length of greater than 400 times the pipe wall thickness in a quantity which during rapid cooling provides an equivalent cooling speed of greater than 1° C./second of the pipe wall over the pipe length to a temperature in the range of 500° C. to 250° C., whereupon further cooling of the pipe down to room temperature is carried out by exposure to air.

11 Claims, 4 Drawing Sheets

(56) References Cited

U.S. PATENT DOCUMENTS

| | | | | |
|---|---|---|---|---|
| 5,816,092 | A * | 10/1998 | Pehle et al. | 72/224 |
| 2002/0020474 | A1 * | 2/2002 | Meyer et al. | 148/511 |

FOREIGN PATENT DOCUMENTS

| | | | |
|---|---|---|---|
| WO | WO 98/38345 | A1 | 9/1998 |
| WO | WO 2007/113642 | A2 | 10/2007 |

* cited by examiner

METHOD AND APPARATUS FOR PRODUCING STEEL PIPES HAVING PARTICULAR PROPERTIES

CROSS-REFERENCES TO RELATED APPLICATIONS

This application is a National Stage of International Application No. PCT/AT2009/000439 filed Nov. 16, 2009, and which claims the benefit of Austrian Patent Application No. A 1814/2008, filed Nov. 20, 2008, the disclosures of which are incorporated herein by reference.

The invention relates to a method for producing pipes made of steel having improved strength and improved toughness of the material.

In addition, the invention relates to a device for producing pipes having a special profile of properties, consisting of a device for applying a cooling medium to the surface of the pipe.

In manufacturing seamless pipes, the properties of the material of the pipe wall may exhibit substantial variations locally and from one lot to the next. These differences in properties are usually based on an irregular microstructure and an unfavorable steel composition and/or an increased proportion of contaminants and accompanying elements.

For pipes that are subjected to high stresses, a microstructure that meets these requirements and is uniform within narrow limits over the length of the pipe as well as coaxially in the pipe wall while also having a material composition that is free of harmful elements should be obtained for the reasons given above.

Pipes that are 7 meters or more long and have an outside diameter of less than 200 mm with a wall thickness of less than 25 mm can be subjected to a heat treatment only with a great deal of complexity, but such a heat treatment produces a uniformly fine structure with the desired microstructure over the entire volume of the pipe while minimizing bending at a right angle to the longitudinal direction.

There are known methods in which a pipe is rotated about its axis and is cooled on the outside surface and/or on the inside surface. However, such heat treatment methods presuppose an approximately uniformly high temperature of the material over the length of the pipe in order to achieve a homogeneous microstructure in the wall.

Figure 1:
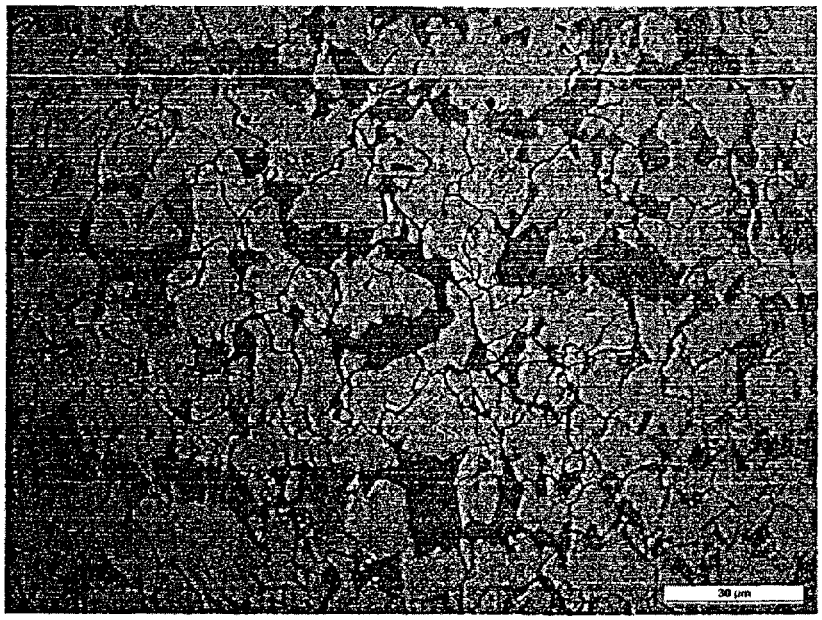
FIG. 1 is an illustrating showing the structure of sample P1, where the grain size is 20 μm to 30 μm with a high ferrite content.

The goal of the present invention is to provide a method with which, during the production of a pipe by hot forming, in particular by stretch reducing, the pipe is treated downstream in a step that increases the strength and improves the toughness of the pipe material.

In addition, another object of the present invention is to create a device for producing pipes with which after heat shaping, pipes having the desired profile of properties over the entire length of the pipe can be produced.

This goal is achieved with a generic method in which a cooling medium at an elevated pressure is applied by direct rapid cooling after a heat shaping, in particular after shaping by means of stretch reduction, such that a cooling medium at an elevated pressure and at a temperature greater than 700° C. but less than 1050° C. in passage is applied to the outside surface of the pipe over its circumference for a length amounting to more than 400 times the wall thickness of the pipe and this is accomplished within a period of at most 20 sec after the last shaping, the cooling medium being applied in an amount which yields a uniform cooling rate of more than 1° C./sec of the pipe wall in rapid cooling over the length of the pipe to a temperature in the range of 500° C. to 250° C., after which the pipe is cooled further to room temperature in air.

Especially high and uniform mechanical material values, in particular toughness values can be achieved by the inventive method if the onset of rapid cooling of the outside surface of the pipe occurs at a temperature of less than 950° C.

For an integrated tempering treatment, it may also be advantageous if a targeted reheating of the pipe wall surface area is performed after the rapid cooling with further cooling of the pipe in air.

To optimize the quality of the pipe and/or to improve the quality of the pipe material, in a refinement of the method, it may be essential to the invention for steel having the following concentrations of the respective alloy elements and accompanying elements and/or impurities in wt % to be used for producing the pipe:

| | |
|---|---|
| Carbon (C) | 0.03 to 0.5 |
| Silicon (Si) | 0.15 to 0.65 |
| Manganese (Mn) | 0.5 to 2.0 |
| Phosphorus (P) | max. 0.03 |
| Sulfur (S) | max. 0.03 |
| Chromium (Cr) | max. 1.5 |
| Nickel (Ni) | max. 1.0 |
| Copper (Cu) | max. 0.3 |
| Aluminum (Al) | 0.01 to 0.09 |
| Titanium (Ti) | max. 0.05 |
| Molybdenum (Mo) | max. 0.8 |
| Vanadium (V) | 0.02 to 0.2 |
| Nitrogen (N) | max. 0.04 |
| Niobium (Nb) | max. 0.08 |
| Iron (Fe) | remainder. |

If the method is used to produce seamless pipes with a length of greater than 7 meters, in particular up to 200 meters, an outside diameter of more than 20 meters but less than 200 meters, a wall thickness of more than 2.0 mm but less than 25 mm, then the increased pipe quality can reduce the need for stockpiling with a substantial advantage and can minimize damages due to breakage with substantial repair costs.

With a limited carbon content, at least one element of the steel may advantageously contain the elements, where the amounts are given in wt %, with regard to a homogeneous high pipe quality:

| | |
|---|---|
| Carbon (C) | 0.05 up to 0.35 |
| Phosphorus (P) | max. 0.015 |
| Sulfur (S) | max. 0.005 |
| Chromium (C) | max. 1.0 |
| Titanium (Ti) | max. 0.02. |

The additional object of the invention to create a device for producing pipes made of steel with an increased strength and improved toughness of the material by rapid cooling after shaping consisting of a device for applying a cooling medium to a pipe surface is achieved by the fact that, after the last shaping mill in the direction of rolling, a switchable cooling through-zone having a plurality of distributor rings for the cooling medium that can be positioned in different ways in the longitudinal direction and are arranged concentrically around the rolled material is designed with at least three nozzles each directed essentially toward the axis, whereby each distributor ring or each group of same can be supplied with the cooling medium in a process that is regulated based on throughput.

With the inventive device, it is advantageously possible to subject pipes of different longitudinal extents and different diameters and wall thicknesses to a targeted heat treatment from the rolling heat such that the desired microstructure, which is represented uniformly over the length of the pipe, can be obtained.

It has been found to be especially advantageous with regard to the uniformity of the structure both circumferentially and in the longitudinal direction of the pipe wall if the nozzles each create a pyramid-shaped cooling medium flow which expands in the direction of spraying.

The cooling medium flow may be designed as a spray stream of cooling medium, usually water, and/or as a spray mist of cooling medium and air and/or as a gas stream.

Advantageous results with regard to a uniformly high quality of the pipe have also been achieved when the cooling medium flow has a rectangular cross-sectional shape and the longer axis of the rectangle is directed obliquely to the axis of the pipe.

Switchability and controllability of throughput of the cooling medium flows in the cooling through-zone are essential to the present invention.

If a supply of cooling medium to the cooling through-zone can be switched as a function of the position of the pipe ends in this zone, then penetration of cooling medium into the interior of the pipe can be prevented in an advantageous manner, so that essentially unilateral interior cooling in the cross section can be prevented and bending as well as the development of an irregular microstructure can be suppressed.

Control systems for pipe cooling with position sensors and temperature sensors to control the cooling medium streams are used to advantage according to the present invention.

The present invention is explained in greater detail below on the basis of examples which illustrate only one type of embodiment.

EXAMPLE 1

Using pipe precursor material from the same parent melt having a chemical composition in wt % according to Table 1:

| Designation | C | Si | Mn | P | S | Cr | Ni | Cu | Al | Mo | Fe |
|---|---|---|---|---|---|---|---|---|---|---|---|
| Pipe blank diameter | 0.1819 | 0.2910 | 1.4231 | 0.0146 | 0.0065 | 0.0415 | 0.0275 | 0.0211 | 0.0274 | 0.0126 | remainder |

ultimately pipes having the following dimensions were produced:

| | |
|---|---|
| Pipe length (rolling length) (L) | 19,300.00 mm |
| Pipe diameter (Ø) | 146.00 mm |
| Pipe wall thickness | 9.70 mm |

After the last step and/or after the final shaping in the discharge station of the stretch reducing plant, the pipe was introduced into a cooling through-zone at a temperature of 880° C. after a period of 12 sec.

Assuming the defined conversion behavior of the steel, the cooling medium flow was directed only at the outside surface of the pipe in investigations on individual lots in pipe production, such that a cooling rate of approx. 6° C./sec was measured by adjusting the cooling medium flow at the following final temperatures:

Temperature Identification of the Sample

| | |
|---|---|
| T1 = 850° C. | P1 |
| T2 = 480° C. | P2 |
| T3 = 380° C. | P3 |
| T4 = 300° C. | P4 |

After achieving these specified final cooling temperatures, the cooling medium supply was shut down and the pipe was cooled further to room temperature at a low intensity essentially in stationary air.

Samples were taken of the pipes that had been heat treated in various ways and labeled as P1 through P4 and then tests of materials were performed on these samples.

A determination of the microstructure revealed that there was an advantageously directional structure in each case, essentially without texture but with a grain size and structure distribution which depend on the final cooling temperature.

FIG. 1 shows the structure of sample P1, where the grain size is 20 μm to 30 μm with a high ferrite content. The remaining component of the structure was mainly perlite.

Figure 2:
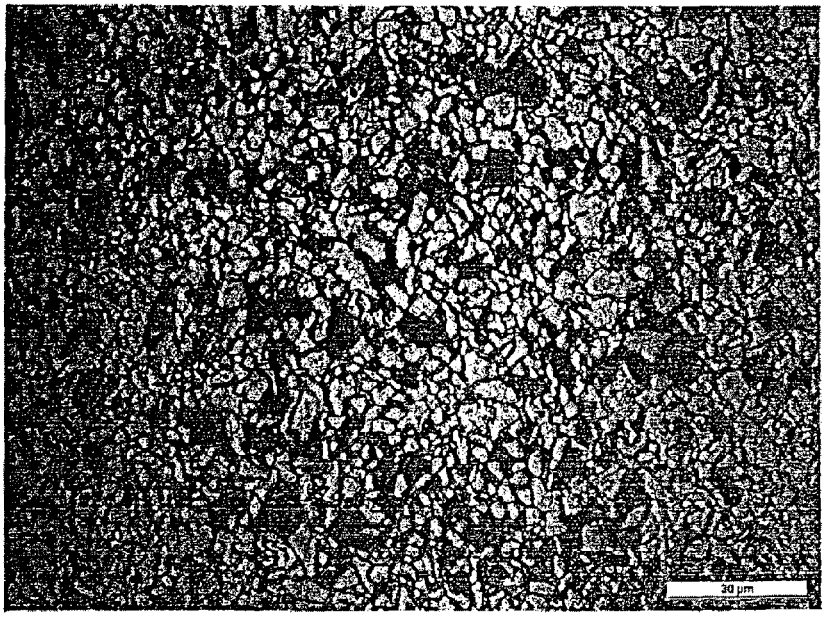
FIG. 2 is an illustrating showing a much smaller average grain size of sample P2 of approx. 5 μm to 8 μm.

FIG. 2 shows a much smaller average grain size of sample P2 of approx. 5 μm to 8 μm, which correlates with a low final cooling medium temperature of T2=480° C. In addition, the perlite content in the ferrite has a finer structure and the amount is slightly greater.

Figure 3:
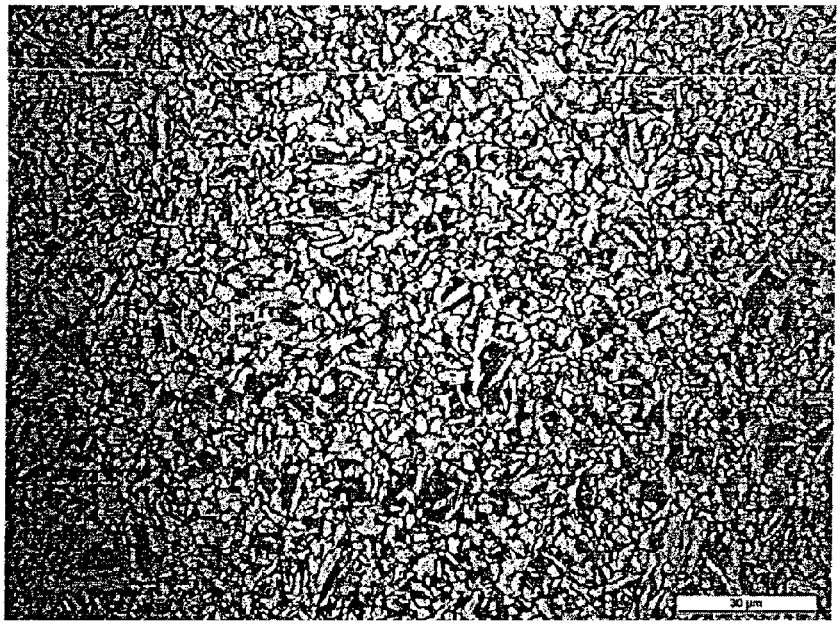
FIG. 3 is an illustrating showing the material of sample P3 has a fine grain due to a high seed count conversion and recrystallization of the structure at a final cooling temperature of T3=380 C.

FIG. 3 shows that the material of sample P3 has a fine grain due to a high seed count conversion and recrystallization of the structure at a final cooling temperature of T3=380° C. and also has largely homogeneously distributed ferrite regions which increase strength. Perlite and the structure of the upper intermediate stage and/or upper bainite were the other constituents of the refined structure.

Figure 4:
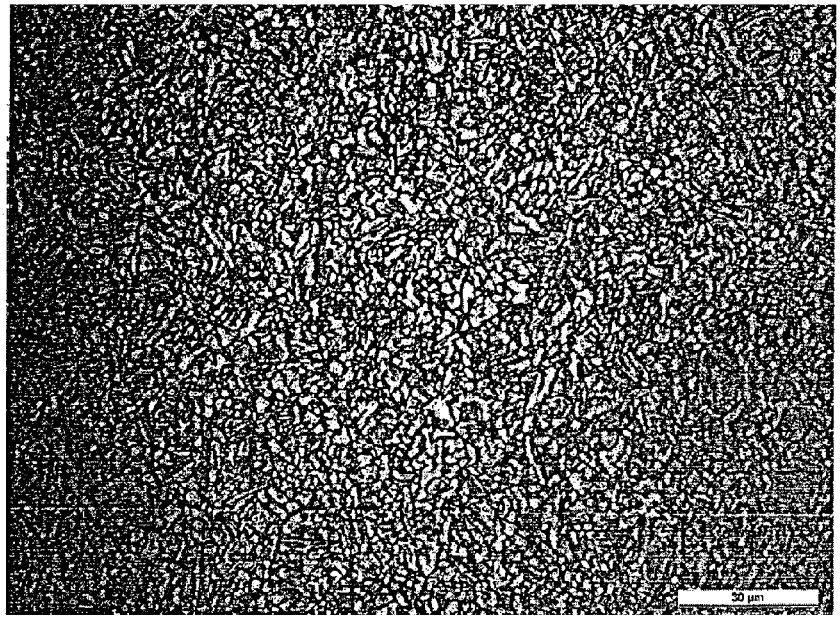
FIG. 4 is an illustrating showing the structure of pipe wall P4, which was formed in rapid cooling after shaping to a final cooling temperature T4=300 C.

FIG. 4 shows the structure of pipe wall P4, which was formed in rapid cooling after shaping to a final cooling temperature T4=300° C. Extremely fine-grained ferrite phases, which are globulitic due to end limitation with fine lamellar perlite and intermediate stage components in the lower bainite range, result in high strength values with improved strain results for the material.

In cooling of the pipe wall at a rate of greater than 1° C./sec immediately after hot shaping of the basic iron material, an austenite structure shaped in this way can be largely undercooled with respect to the equilibrium resulting in a conversion of the structure as a function of the extent of the undercooling and the seed state. The desired uniform microstructure can be established advantageously by means of the inventive method over the entire length of a pipe and surprisingly also over its cross section and this microstructure also determines the properties of the material. In other words, if fundamental material properties are required of a pipe, choice of an alloy is indicated. An advantageous and favorable profile of properties of the material which is provided can be achieved through an inventive method in the device according to the invention.

Figure 5:
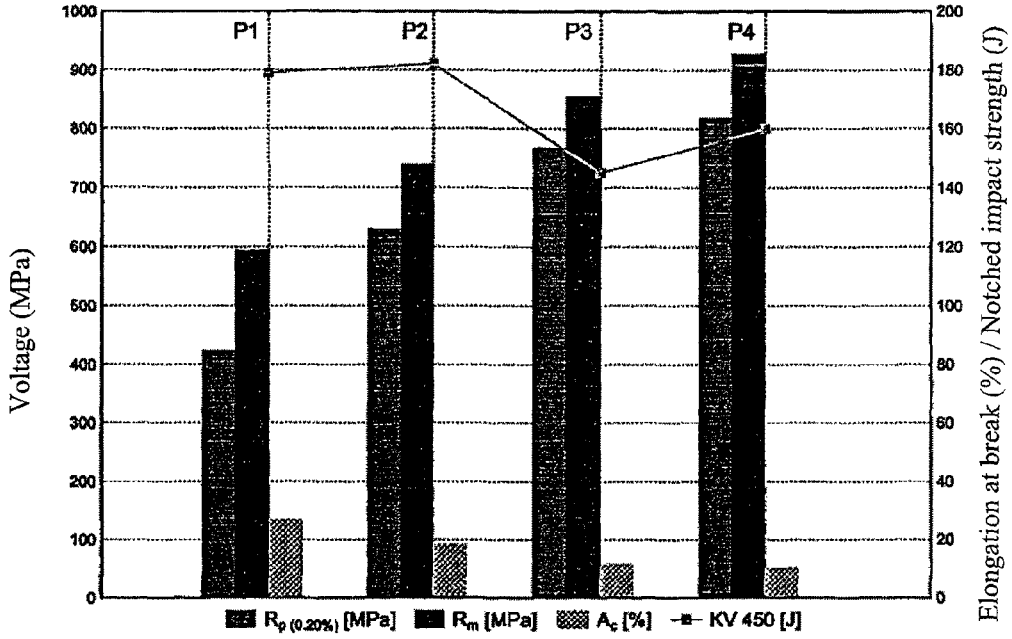
FIG. 5 is a bar graph illustration showing measured values for samples P1 through P4.

FIG. 5 shows in a bar graph the measured values for strain limit (Rp) (0.2) [MPa], tensile strength (Rm) [MPa], necking (Ac) [%] and toughness (KV450) [J] of the samples P1 through P4, i.e., as a function of the mechanical properties of the material which are achieved through the different cooling parameters in the refining technology.

With the same steel composition, the strain limit of the material of the pipe wall can be increased from 424 [MPa] to 819 [MPa] while at the same time the decline in strain values from 26 [%] to 10 [%] can be minimized, which causes the toughness of the material to decline from 170 [J] to 160 [J].

At high final cooling temperatures as is the case for sample material P1 for example, there is a great deal of recrystallization and formation of large grains, which imparts high toughness and necking to the material but causes a comparatively low level of strength.

Cooling to lower ambient temperatures increases the strength of the pipe wall and naturally also slightly reduces the necking and toughness of the material, as illustrated on the basis of samples P2, P3 and P4.

With the inventive method, microstructures can also be adjusted in the material in a targeted manner, yielding the profile of properties of the pipe wall. For example, a high measure of conversion to a lower bainite structure can be achieved in sample pipe P4 by means of a low conversion temperature, so an increased toughness of the material could be achieved.

Figure 6:
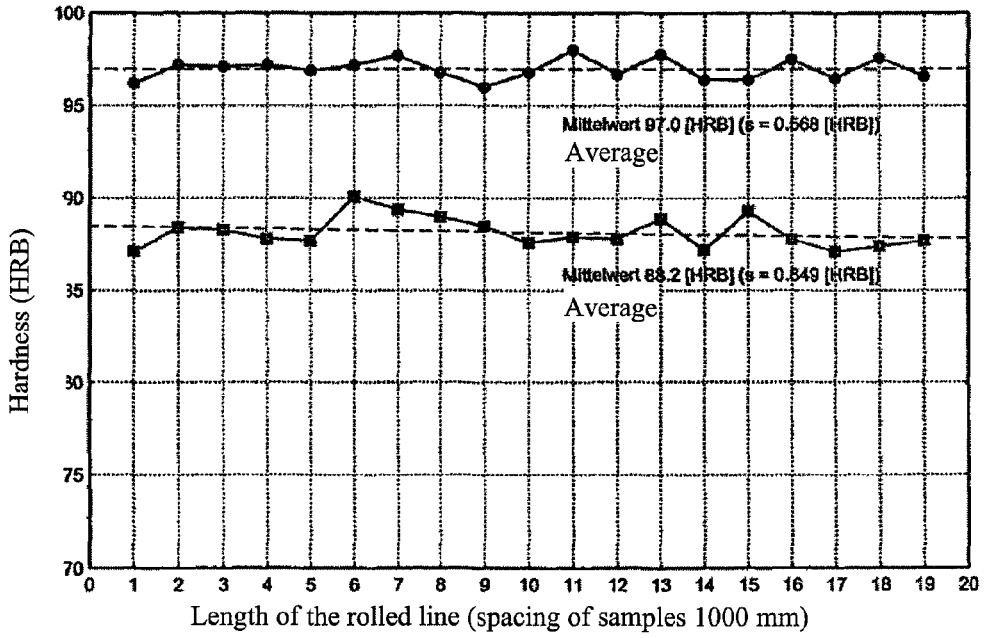
FIG. 6 is an illustrating showing measured hardness values over the length of experimental pipes P1 and P4.

FIG. 6 shows the measured hardness values over the length of the pipe of experimental pipes P1 and P4. It has been found that a scattering S of the material hardness over the length of the pipe is also reduced with an increase in hardness [HRB] and strength levels of the material due to intensified application of cooling medium.

Figure 7:
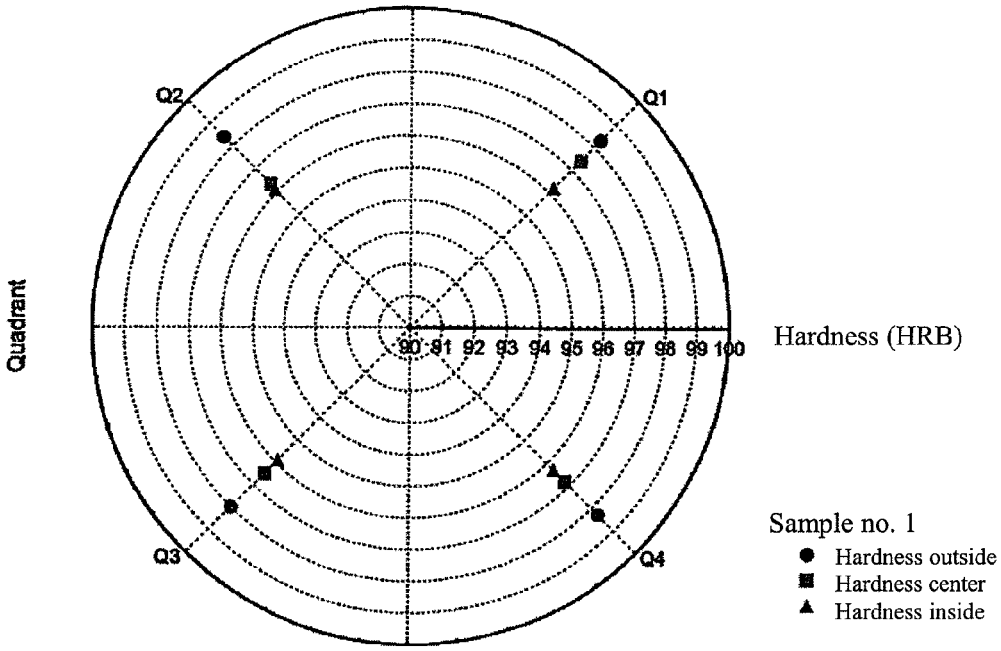
FIG. 7 is an illustrating showing the hardness curve of the material in the quadrants as a function of the thickness of the pipe wall of experimental pipe P2.

FIG. 7 shows the hardness curve of the material in the quadrants as a function of the thickness of the pipe wall of experimental pipe P2.

The measurement results of the four quadrants Q1 to Q4 are averages of four measurements spaced a distance apart in each quadrant in the external, central and internal areas of the pipe wall.

As also shown by the comparison of the respective hardness values over the cross section of the pipe wall in the quadrants, there are only extremely minor differences in material strength, so the achievable quality of the product is represented by using the inventive method and such a device.

The invention claimed is:

1. A method for producing a seamless steel pipe with an increased strength and improved toughness of the material by direct rapid cooling after a heat shaping, such that a cooling medium at an increased pressure is applied to the outside surface of the seamless pipe circumferentially for a length of more than 400 times the thickness of the seamless pipe wall within a period of at most 20 sec after the last shaping at a temperature greater than 700° C. but below 1050° C. in a continuous process, wherein the cooling medium is prevented from entering the interior of the seamless pipe, said cooling medium being applied in an amount which produces an equivalent cooling rate of greater than 1° C/sec of the seamless pipe wall over the length of the seamless pipe to a temperature in the range of 500° C. to 250° C. in rapid cooling, after which the pipe is cooled further in air to room temperature.

2. The method according to claim 1, wherein the start of rapid cooling of the outside surface of the seamless pipe begins at a temperature below 950° C.

3. The method according to claim 1, wherein after the rapid cooling, a targeted reheating of the seamless pipe wall takes place after further cooling of the pipe in air.

4. The method according to claim 1, wherein steel with a concentration of the respective alloy elements and accompanying elements and/or contaminating elements in wt% is used for production of the seamless pipe:

| | |
|---|---|
| Carbon (C) | 0.03 to 0.5 |
| Silicon (Si) | 0.15 to 0.65 |
| Manganese (Mn) | 0.5 to 2.0 |
| Phosphorus (P) | max. 0.03 |
| Sulfur (S) | max. 0.03 |
| Chromium (Cr) | max. 1.5 |
| Nickel (Ni) | max. 1.0 |
| Copper (Cu) | max. 0.3 |
| Aluminum (Al) | 0.01 to 0.09 |
| Titanium (Ti) | max. 0.05 |
| Molybdenum (Mo) | max. 0.8 |
| Vanadium (V) | 0.02 to 0.2 |
| Tin (Sn) | max 0.08 |
| Nitrogen (N) | max. 0.04 |
| Niobium (Nb) | max. 0.08 |
| Calcium (Ca) | max 0.005 |
| Iron (Fe) | remainder. |

5. The method according to claim 1, wherein the seamless pipe is an oil field pipe having a length of more than 7 m, an outside diameter of more than 20 mm but less than 200 mm and a wall thickness of more than 2.0 mm but less than 25 mm.

6. The method according to claim 4, wherein steel with the concentration of the respective alloy elements and accompanying elements and/or contaminating elements in wt% is used for production of the seamless steel pipe:

| | |
|---|---|
| Carbon (C) | 0.03 to 0.5 |
| Silicon (Si) | 0.15 to 0.65 |
| Manganese (Mn) | 0.5 to 2.0 |
| Phosphorus (P) | max. 0.03 |
| Sulfur (S) | max. 0.03 |
| Chromium (Cr) | max. 1.5 |
| Nickel (Ni) | max. 1.0 |
| Copper (Cu) | max. 0.3 |
| Aluminum (Al) | 0.01 to 0.09 |
| Titanium (Ti) | max. 0.05 |
| Molybdenum (Mo) | max. 0.8 |
| Vanadium (V) | 0.02 to 0.2 |
| Tin (Sn) | max 0.08 |
| Nitrogen (N) | max. 0.04 |
| Niobium (Nb) | max. 0.08 |
| Calcium (Ca) | max 0.005 |
| Iron (Fe) | remainder. |

7. The method according to claim 1, wherein the heat shaping comprises shaping by stretch reduction.

8. The method according to claim 5, wherein the length is more than 7 m and up to 200 m.

9. A method for producing a seamless heat-treated pipe, comprising:

heat shaping a seamless pipe;

subsequently applying direct rapid cooling to the seamless pipe by applying a pressurized cooling medium to the outside circumferential surface of the seamless pipe over a length of more than 400 times the thickness of the seamless pipe wall within a period of at most 20 sec after completion of the heat shaping at a temperature greater than 700° C. but below 1050° C. in a continuous process, wherein the cooling medium is prevented from entering the interior of the seamless pipe, said cooling medium being applied in an amount which produces an equivalent cooling rate of greater than 1° C/sec of the seamless pipe wall over the length of the seamless pipe to a temperature in the range of 500° C. to 250° C. in rapid cooling; and subsequently further cooling the seamless pipe in air to room temperature.

10. The method of claim 9, wherein the heat shaping comprises shaping by means of stretch reduction, and wherein the cooling step is subsequent to the stretch reduction.

11. The method according to claim 6, wherein the steel contains at least one element in the following amount in wt% for production of the seamless pipe:

| | |
|---|---|
| Carbon (C) | 0.05 up to 0.35 |
| Phosphorus (P) | max. 0.015 |
| Sulfur (S) | max. 0.005 |
| Chromium (C) | max. 1.0 |
| Titanium (Ti) | max. 0.02. |

* * * * *